United States Patent [19]

Ivanov

[11] Patent Number: 4,495,789

[45] Date of Patent: Jan. 29, 1985

[54] FRAME-STRAIGHTENING DEVICE

[76] Inventor: Peter Ivanov, 1826 S. Fitch Mountain Rd., Healdsburg, Calif. 95448

[21] Appl. No.: 434,769

[22] Filed: Oct. 18, 1982

[51] Int. Cl.[3] ..... B21D 1/14; B21D 3/12

[52] U.S. Cl. ..... 72/302; 72/705; 254/93 R; 92/132

[58] Field of Search ..... 72/705, 302, 305; 254/93 R; 92/132

[56] References Cited

U.S. PATENT DOCUMENTS

| | | | |
|---|---|---|---|
| 2,100,564 | 11/1937 | Mandl et al. | 254/93 H |
| 2,835,154 | 5/1958 | Geller | 72/705 |
| 2,973,566 | 3/1961 | Elsner | 254/93 R |
| 3,201,968 | 8/1965 | Hill | 72/705 |
| 3,224,730 | 12/1965 | Fischler | 254/93 R |
| 3,276,237 | 10/1966 | Transue | 72/705 |
| 3,492,855 | 2/1970 | Wylie | 72/705 |
| 3,499,629 | 3/1970 | Horton | 254/93 R |
| 3,769,836 | 11/1973 | Heldenbrand | 72/302 |
| 3,893,650 | 7/1975 | Turben | 254/93 R |
| 4,461,457 | 7/1984 | Steele | 72/705 |

*Primary Examiner*—Lowell A. Larson

*Attorney, Agent, or Firm*—Townsend & Townsend

[57] ABSTRACT

A device for use with a hydraulic cylinder or like for straightening frame members, which converts the extension stroke of the cylinder to a pulling action. The device has a pair of interengaging outer members which are formed to define an elongate cage. The interengaging members are slidably connected to one another for relative movement in the direction of the longitudinal axis of the cage. Retaining means are mounted on the interengaging outer members, which are adapted to removably retain a hydraulic cylinder within the cage aligned along the central longitudinal axis, so that extension of the cylinder causes a contraction of the interengaging member along the direction of the longitudinal axis. The interengaging members are adapted at opposite ends for connection to a frame member to be straightened.

1 Claim, 3 Drawing Figures

FRAME-STRAIGHTENING DEVICE

BACKGROUND OF THE INVENTION

The present invention relates to tools for the repair of heavy equipment or machinery and, in particular, is directed to apparatus for straightening automobile chassis and the like.

In the repair of an automobile body which has been dented in a severe accident, it is often necessary to exert large forces on selected frame members to straighten or realign the framework. In particular it is often necessary to exert a pushing or pulling force between two points, for example, to correct for skewness in the frame. As used herein the term "straighten" refers to the correction of misaligned or bent frame members, regardless of whether the corrected members assume a "straight" configuration.

Numerous types of hydraulic jacks are known which can be inserted between two points to exert a pulling or pushing force. The known hydraulic jacks are subject to various disadvantages. In some devices, for example, that disclosed in U.S. Pat. No. 3,891,187, a double-acting hydraulic cylinder is employed to produce both a pushing and a pulling action. This type of cylinder provides for both powered extension and powered retraction of a cylinder rod. However, the powered extension is generally stronger than the powered retraction, so that devices driven by such a cylinder will not push and pull with equal force. If the pushing action just meets the minimum requirements for the intended use, then the pulling action will not.

In the process of straightening an automobile chassis or frame member, the hydraulic jack device is itself sometimes subject to strong skew reaction forces. In some devices the driving cylinder is susceptible to damage by these forces. In other devices more complicated, and more expensive, constructions are employed to protect the cylinder.

One device which is almost universally found in autobody shops is the basic hydraulic ram used to exert a pushing force. To some extent, then, a self-contained unit providing both a pushing and a pulling force represents a duplication of equipment and an unnecessary expense. Highly desirable and cost-effective is a device for converting pushing action of the basic hydraulic ram into a pulling action. One such device is disclosed in U.S. Pat. No. 3,518,864. That device, however, employs slidably mounted tubular members, which are subject to jamming and damage from skew reaction forces.

SUMMARY OF THE INVENTION

The present invention provides a device for use with a standard hydraulic cylinder for straightening frame members, which overcomes the disadvantages of the prior art mentioned above. Briefly, a device constructed in accordance with the invention comprises a pair of interengaging outer members, which are formed to define an inner elongate cage. The interengaging members are slidably connected to one another for relative movement along the longitudinal axis of the cage. Retaining means mounted on the interengaging outer members are adapted to removably retain a hydraulic cylinder within the cage along the central longitudinal axis. The interengaging outer members are adapted at the opposite ends thereof to be connect to a frame member to be straightened. In this manner extension of a hydraulic cylinder mounted within the cage will cause the interengaging outer members to undergo relative sliding motion so as to retract with respect to one another, thereby producing a pulling action on the frame members.

It is an object of the invention to provide a device, empowered by hydraulic cylinder, which exerts a pulling force equal to the pushing force of the cylinder.

It is a further object of the invention to provide a device into which a standard hydraulic cylinder can readily be mounted for powering the device and readily removed for use separately.

It is a further object of the invention to provide a device in which the driving cylinder is not readily susceptible to damage.

It is a feature of the invention that it provides a particularly simple construction which is inexpensive to manufacture and easy to repair when damaged.

A fuller understanding of the nature, advantages, and objects of the invention will be gained by reference to the remaining portions of the specification and to the attached drawings.

DETAILED DESCRIPTION OF THE PREFERRED EMBODIMENTS

Figure 1:
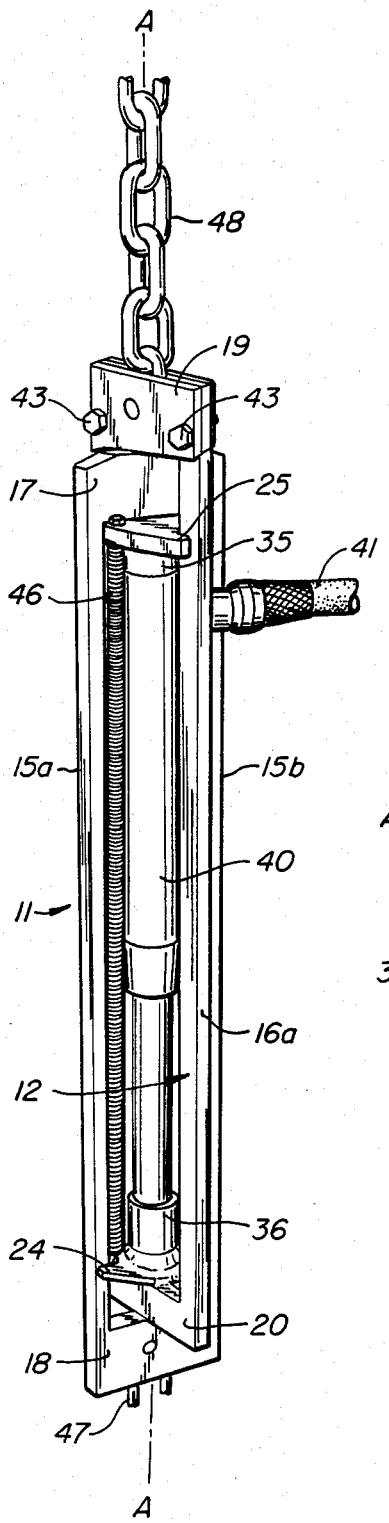
FIG. 1 is a perspective view of a frame straightening device constructed in accordance with the invention.

As illustrated in FIG. 1, a frame straightening device constructed in accordance with the invention comprises a pair of interengaging outer members 11 and 12, each of which has the shape of an elongate loop and which interengage with one another so as to define an elongate cage for containing an actuating cylinder, hydraulic ram, or the like. In the preferred embodiment each of the outer members 11 and 12 comprises a pair of elongate, substantially parallel arms. As seen in FIG. 1, arms **15*a* and 15*b* belong to outer member 11, and arm 16*a* belongs outer member 12 (the second arm corresponding to arm 16*a* is not visible in the view of FIG. 1). The arms of each pair are connected at their ends by cross members 17 and 18 of outer member 11 and cross members 19 and 20 of outer member 12**.

In the preferred embodiment of the invention the device includes two outer members as just described, which are configured so that their total of four arms are equiangularly spaced about the central longitudinal axis AA of the cage.

The outer members 11 and 12 are slidably connected to one another for relative movement along the longitudinal axis AA. To achieve the sliding connection, the first cross member 20 of outer member 12 is disposed between the arms **15*a* and 15*b* of outer member 11, and the first cross member 17 of outer member 11 is likewise disposed between the arms of outer member 12. The cross members 20 and 17 are provided with guide means 24 and 25, respectively, which project to either side from the cross members and which slidably engage the arms of the opposite outer member. In the preferred embodiment the guide means 24 and 25** are formed to define a notch for receiving the associated arm. The notch arrangement is most visible in FIG. 2, which shows an alternative embodiment of a cross member 31, guide means 32 projecting outwardly from cross member 31, and arm 33 disposed within the notch defined by guide means 32.

Each of the outer members 11 and 12 includes a retaining means 35 and 36 secured to the respective cross members 17 and 20, which is adapted to retain an end of a hydraulic jack or the like for driving the frame-straightening device. The retaining means 35 and 36 are preferably cup-shaped for receiving an end of the hydraulic cylinder. The cup-shaped structure can be seen in the retaining means 37 of the embodiment of FIG. 2.

Figure 2:
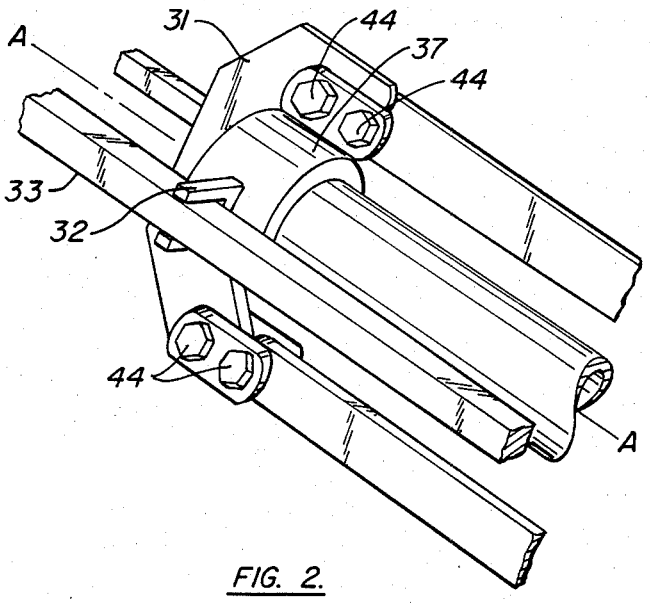
FIG. 2 is a perspective view showing an alternative embodiment of the invention.

In the embodiment of FIG. 1 the device is driven by jack cylinder 40, which is pneumatically actuated through air hose 41. Such jack cylinders are extremely useful in their own right and are readily to be found in autobody repair shops and other such shops. For example, a cylinder suitable for use with the present invention is the Porto-Power ® hydraulic ram model RC-540 available from Blackhawk Manufacturing Company of Milwaukee, Wis. It is an advantage of the invention that commonly found jack cylinders can be removably mounted within the cage defined by the members 11 and 12 in order to convert the pushing action of the cylinder into a pulling action. To facilitate the mounting and demounting of cylinder 40 within the retaining means 35 and 36, at least one of the arms (16*a* of FIG. 1) is detachably connected at at least one end thereof to the associated cross member. In FIGS. 1 and 2 the detachable connection is provided by bolts 43 and 44. Once detached, the arm 16*a* can be urged out of the retaining notch of guide means 25 to provide more room, in essence, to open the cage, for removal of the cylinder 40.

Because the outer members 11 and 12 are constructed to slide along one another, a driving cylinder which is in less than its fully extended configuration can sometimes accidently be released from the retaining means. To prevent accidental release of the cylinder, the device may be provided with bias means such as spring 46 for urging the cross members 17 and 20 toward one another.

To apply the frame-straightening device the interengaging outer members 11 and 12 are adapted at the opposite ends 18 and 19 for connection to a frame member to be straightened. This connection is achieved in the embodiment of FIG. 1 by lengths of chain 47 and 48 which are secured to the cross members 18 and 19.

Figure 3:
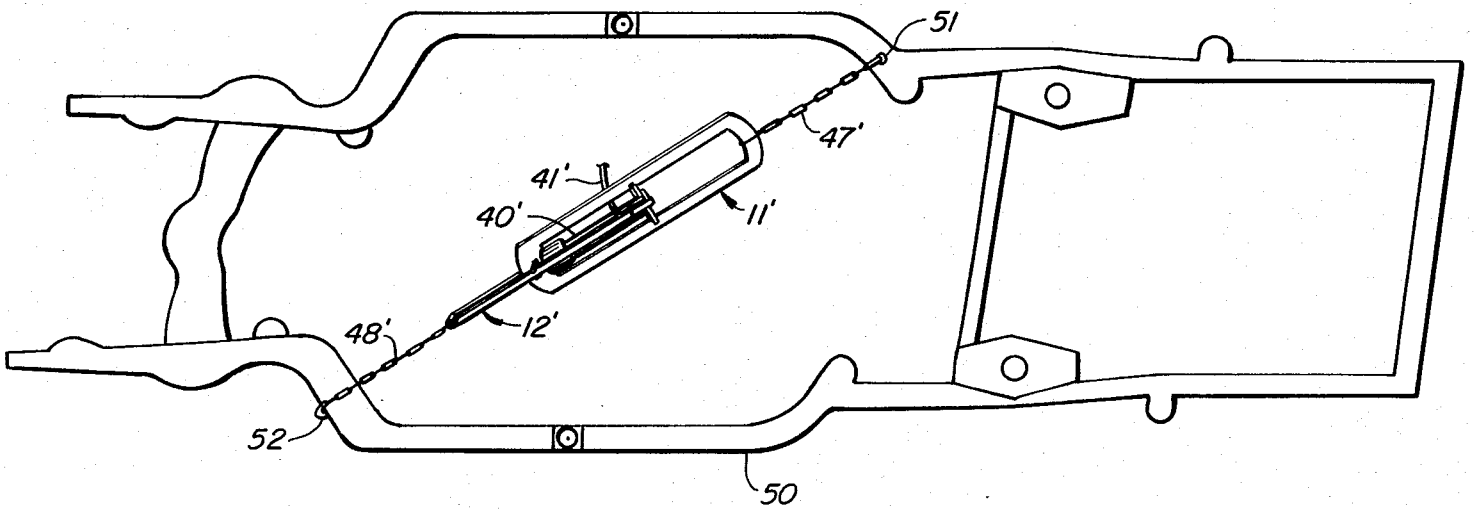
FIG. 3 is a perspective view showing an application of the frame straightening device to a misaligned framework.

Once a jack cylinder is inserted within the cage defined by the outer members, the frame-straightening device is ready for use. The device is applied in the same manner as other, known frame-straightening devices, which will be well understood by those skilled in the art. A typical application is shown in FIG. 3, wherein reference numerals corresponding to those of FIG. 1 indicated corresponding elements. If it is desired to pull points 51 and 52 of framework 50 toward one another, then cylinder 40′ is reduced to its most retracted configuration. The lengths of chain 47′ and 48′ are then secured to the framework 50 at points 51 and 52 by well known means. Extension of the cylinder 40′ then causes the members 11′ and 12′ to retract with respect to one another, thereby exerting tension on the chain lengths 47′ and 48′, which in turn exerts the desired pulling force between points 51 and 52.

In summary, the present invention provides a device for converting the pushing movement of a jack cylinder into a pulling movement. It is particularly inexpensive to fabricate, has few moving parts or highly machined parts, and makes the most expedient use of existing jack cylinders, which are already to be found in any well equipped repair shop. In achieving its pulling action, the invention takes advantage of the more powerful extension stroke of the jack cylinder rather than the generally weaker retraction stroke.

While the above provides a full and complete disclosure of the preferred embodiments of the invention, various modifications, alternate constructions, and equivalents will occur to those skilled in the art given the benefit of this disclosure. Such modifications and alternate constructions are considered to fall within the spirit and scope of the invention disclosed herein, which is defined by the appended claims.

What is claimed is:

1. A device for use with a jack cylinder for straightening frame members, comprising:

first and second outer members, each outer member comprising a pair of elongate substantially parallel arms and first and second cross members connecting said arms at the ends thereof;

said outer members being slidably mounted to one another for relative longitudinal movement with the arms of said outer members being angularly spaced about a central longitudinal axis and said first cross member of each said outer member being provided with the first and second guide members projecting to opposite sides and slidably engaging the arms of the opposite outer member to retain said first cross member therebetween;

each said guide member being formed with an outward opening U-shaped member sized to receive an arm of said opposite outer member;

retaining means secured to said first cross member of each said outer member and adapted to receive an end of a jack cylinder whereby said cylinder can be removably mounted interiorly between both said pairs of arms along said central axis;

means biasing said first cross members of said outer members toward one another for preventing accidental release of said cylinder from said retaining means;

at least one of said arms being detachably connected at an end thereof to a cross member whereby said detachably connected arm may be urged outward from its engaging U-shaped member to facilitate mounting and removal of said cylinder between said pairs of arms; and wherein said second cross member of each said outer member is adapted for connection to a frame member to be straightened.

* * * * *